US012258745B2

(12) United States Patent
Twaroski et al.

(10) Patent No.: US 12,258,745 B2
(45) Date of Patent: Mar. 25, 2025

(54) WATER CLOSET CARRIER

(71) Applicant: Zurn Water, LLC, Milwaukee, WI (US)

(72) Inventors: Jacob D. Twaroski, Wattsburg, PA (US); Christopher J. Say, Erie, PA (US)

(73) Assignee: Zurn Water, LLC, Milwaukee, WI (US)

( * ) Notice: Subject to any disclaimer, the term of this patent is extended or adjusted under 35 U.S.C. 154(b) by 51 days.

(21) Appl. No.: 18/309,592

(22) Filed: Apr. 28, 2023

(65) Prior Publication Data

US 2023/0349142 A1 Nov. 2, 2023

Related U.S. Application Data

(63) Continuation of application No. 29/792,925, filed on Apr. 29, 2022.

(60) Provisional application No. 63/363,927, filed on Apr. 29, 2022.

(51) Int. Cl.
*E03D 11/14* (2006.01)

(52) U.S. Cl.
CPC ..... *E03D 11/143* (2013.01)

(58) Field of Classification Search
CPC ..... E03D 11/143; E03D 11/14
See application file for complete search history.

(56) References Cited

U.S. PATENT DOCUMENTS 1,471,154 A 10/1923 Graham
1,582,845 A 4/1926 McArthur
2,015,349 A 9/1935 McArthur
2,065,523 A 12/1936 Groeniger
2,666,211 A 1/1954 Schmid
2,702,391 A 2/1955 Schmid
2,795,798 A 6/1957 Boggess et al.
(Continued)

FOREIGN PATENT DOCUMENTS

CA 2849461 A1 10/2014
CA 2944072 A1 4/2015
(Continued)

OTHER PUBLICATIONS

Zurn Industries, Inc. "Zurn Z-1203-H carrier", specification sheet, Aug. 9, 1994, 1 p. published in USA.
(Continued)

*Primary Examiner* — Christine J Skubinna
(74) *Attorney, Agent, or Firm* — Husch Blackwell LLP

(57) ABSTRACT

A carrier plate for supporting a wall-mounted water closet, the carrier plate including a face plate having a top end, a bottom end opposite the top end, a front face, and a rear face opposite the front face. The carrier plate also including a bracket extending from the rear face of the face plate proximate the top end to define a bracket length, and one or more feet extending from the rear face of the face plate proximate the bottom end to define a foot length and a base plane, where the foot defines an anchor aperture therethrough, where the anchor aperture defines an anchor zone including a volume delineated by the cross-section of the anchor aperture extended normal to the base plane in both directions therefrom, and where the bracket is not positioned within the anchor zone.

20 Claims, 7 Drawing Sheets

(56) References Cited

U.S. PATENT DOCUMENTS

| | | | | |
|---|---|---|---|---|
| 2,810,918 | A | 10/1957 | Baker et al. | |
| RE24,492 | E | 6/1958 | Gordon | |
| 2,932,037 | A | 4/1960 | Manas | |
| 3,014,222 | A | 12/1961 | Pope | |
| 3,054,119 | A | 9/1962 | Manas et al. | |
| 3,098,242 | A | 7/1963 | Ambruster | |
| 3,271,054 | A | 9/1966 | Schmid | |
| 3,271,794 | A | 9/1966 | Flegel | |
| 3,278,950 | A | 10/1966 | Hutchins | |
| 3,286,280 | A | 11/1966 | Duggan | |
| 3,323,143 | A * | 6/1967 | Pope | E03D 11/143 4/252.3 |
| 3,435,467 | A * | 4/1969 | Flegel | E03D 11/143 4/252.2 |
| 3,540,065 | A | 11/1970 | Schmid | |
| D220,829 | S | 6/1971 | Williams | |
| 3,686,695 | A | 8/1972 | Mielback et al. | |
| 3,732,582 | A | 5/1973 | Mielback et al. | |
| 3,944,175 | A | 3/1976 | Kearney | |
| 4,058,859 | A | 11/1977 | Arrowood | |
| 4,091,473 | A | 5/1978 | Matthews et al. | |
| 4,108,477 | A | 8/1978 | Morris | |
| 4,482,161 | A | 11/1984 | Izzi, Sr. | |
| 4,979,239 | A | 12/1990 | Klein et al. | |
| 5,107,638 | A | 4/1992 | Unertl et al. | |
| 5,199,113 | A | 4/1993 | Glasow et al. | |
| 5,205,056 | A | 4/1993 | Okajima et al. | |
| 6,301,838 | B1 | 10/2001 | Hall | |
| 6,889,392 | B1 | 5/2005 | Kamopp et al. | |
| 6,928,669 | B2 | 8/2005 | Akin | |
| 6,979,027 | B2 | 12/2005 | Hetzler et al. | |
| 7,146,655 | B2 | 12/2006 | Karnopp et al. | |
| 7,421,745 | B2 | 9/2008 | Levy et al. | |
| 7,571,497 | B2 | 8/2009 | Hetzler et al. | |
| 8,141,177 | B1 | 3/2012 | Majocka et al. | |
| 8,321,967 | B2 | 12/2012 | Mesun et al. | |
| 8,359,678 | B1 * | 1/2013 | Burdette | E03D 11/143 4/252.2 |
| 8,505,124 | B2 | 8/2013 | Eichler et al. | |
| 8,523,119 | B1 * | 9/2013 | Greer | E03D 11/143 248/65 |
| 8,544,121 | B1 | 10/2013 | Majocka et al. | |
| 8,881,318 | B2 | 11/2014 | Stammel et al. | |
| 8,887,319 | B2 | 11/2014 | Whiteside | |
| 9,021,620 | B1 | 5/2015 | Walker | |
| 9,068,333 | B2 | 6/2015 | Sneve et al. | |
| 9,464,426 | B1 * | 10/2016 | Schaetzke | E03D 11/14 |
| 9,631,353 | B1 | 4/2017 | Walker | |
| 9,732,507 | B2 | 8/2017 | Bucher et al. | |
| D796,652 | S | 9/2017 | Vish et al. | |
| 9,938,707 | B2 | 4/2018 | Frei et al. | |
| 10,358,805 | B2 | 7/2019 | Tanimoto et al. | |
| 10,526,775 | B2 | 1/2020 | Nakamura et al. | |
| D875,224 | S | 2/2020 | Bucher et al. | |
| 10,697,167 | B2 | 6/2020 | Bucher et al. | |
| 10,738,454 | B2 | 8/2020 | Spankowski et al. | |
| 10,851,534 | B2 | 12/2020 | Hetzler et al. | |
| 10,858,815 | B2 | 12/2020 | Fratantonio et al. | |
| 10,895,070 | B2 | 1/2021 | Hodge et al. | |
| 11,060,268 | B1 | 7/2021 | Snyder, Jr. et al. | |
| D956,053 | S | 6/2022 | Kanter | |
| D967,693 | S | 10/2022 | Brunner et al. | |
| D969,592 | S | 11/2022 | Sheth et al. | |
| D969,677 | S | 11/2022 | Smith | |
| D981,419 | S | 3/2023 | Kanter | |
| D992,402 | S | 7/2023 | Mckillips | |
| D999,123 | S | 9/2023 | Smith | |
| 2004/0133969 | A1 | 7/2004 | Akin | |
| 2005/0012329 | A1 | 1/2005 | Brown | |
| 2008/0000018 | A1 | 1/2008 | Laher | |
| 2008/0172953 | A1 | 7/2008 | Plorkowski | |
| 2009/0249535 | A1 | 10/2009 | Eichler et al. | |
| 2013/0205494 | A1 | 8/2013 | Whiteside | |
| 2014/0310860 | A1 | 10/2014 | Wroblewski et al. | |
| 2015/0191903 | A1 | 7/2015 | Doerscher, Sr. | |
| 2016/0090726 | A1 | 3/2016 | Verdecchia et al. | |
| 2016/0237670 | A1 | 8/2016 | Frei et al. | |
| 2016/0312454 | A1 | 10/2016 | Mantel et al. | |
| 2020/0263408 | A1 | 8/2020 | Hodge | |
| 2021/0123225 | A1 * | 4/2021 | Bissell | E03D 11/143 |
| 2022/0243445 | A1 | 8/2022 | Lawrence et al. | |
| 2023/0265874 | A1 * | 8/2023 | Lechner | F16B 7/187 248/231.91 |

FOREIGN PATENT DOCUMENTS

| | | | |
|---|---|---|---|
| FR | 2908141 | B1 | 5/2011 |
| GB | 2223042 | A | 3/1990 |
| GB | 2223042 | B | 5/1992 |
| WO | 2009/071178 | A1 | 6/2009 |
| WO | 2013/062493 | A1 | 5/2013 |
| WO | 2015/061615 | A1 | 4/2015 |
| WO | 2016/162352 | A1 | 10/2016 |
| WO | 2017/203335 | A1 | 11/2017 |
| WO | 2019/190442 | A2 | 10/2019 |
| WO | 2019/194770 | A2 | 10/2019 |

OTHER PUBLICATIONS

Specification Sheet for Z1203-N4-M, "Adjustable Horizontal Siphon Jet No-Hub", Zurn Industries, LLC, Feb. 24, 2011.

Specification Sheet for Z1210-45, "Finishing Frame For Siphon Jet System", Zurn Industries, LLC, Nov. 18, 2010.

* cited by examiner

WATER CLOSET CARRIER

CROSS-REFERENCE TO RELATED APPLICATIONS

This application claims priority to prior-filed, U.S. Provisional Patent Application No. 63/363,927, filed Apr. 29, 2022, and U.S. Design patent application Ser. No. 29/792,925, filed Apr. 29, 2022. The entire contents of both is hereby incorporated by reference.

FIELD OF THE INVENTION

The present invention relates to a water closet carrier for use in a modular wall, and more specifically to a water closet carrier formed from a single monolithic piece of material.

BACKGROUND OF THE INVENTION

Water closets are typically installed using some form of carrier.

SUMMARY

In one aspect, A carrier plate for supporting a wall-mounted water closet, the carrier plate including a face plate having a top end, a bottom end opposite the top end, a front face, and a rear face opposite the front face, where the face plate defines a channel extending between the front face and the rear face configured to receive a fluid coupling member therein, a bracket extending from the rear face of the face plate proximate the top end to define a bracket length, and one or more feet extending from the rear face of the face plate proximate the bottom end to define a foot length and a base plane, where the foot defines an anchor aperture therethrough, and where the anchor aperture defines an anchor zone including a volume delineated by the cross-section of the anchor aperture extended normal to the base plane in both directions therefrom, and wherein the bracket is not positioned within the anchor zone.

Alternatively or additionally, in any combination, where the front face of the face plate defines a front plane, and where the front plane is perpendicular to the base plane.

Alternatively or additionally, in any combination, where the bracket is positioned so that it does not overlap the anchor aperture in a direction taken along the front plane and normal to the front plane.

Alternatively or additionally, in any combination, where the face plate includes a plurality of feet extending from the rear face of the face plate proximate the bottom end, where each foot of the plurality of feet define an anchor aperture, where each anchor aperture defines a corresponding anchor zone, and where the bracket is not positioned within any anchor zone.

Alternatively or additionally, in any combination, where the face plate, bracket, and one or more feet are all formed from a single piece of stock material.

Alternatively or additionally, in any combination, where the face plate defines a channel extending between the front face and the rear face and that is configured to receive a fluid coupling member therein.

Alternatively or additionally, in any combination, further comprising a second bracket extending from the rear face of the face plate proximate the top end, and where the second bracket is not positioned within the anchor zone.

Alternatively or additionally, in any combination, further comprising a mounting point configured to provide a location to which an installation jig may be connected to the carrier plate.

Alternatively or additionally, in any combination, where the mounting point includes a plurality of equally spaced apertures formed into the bracket.

Alternatively or additionally, in any combination, where the mounting point includes an aperture formed into the face plate.

Alternatively or additionally, in any combination, where the one or more feet include a pair of feet defining an anchor width therebetween, and where the anchor length is between 20% to 30% of the anchor width.

In another aspect, a carrier assembly for supporting a wall-mounted water closet, the carrier assembly including an installation jig, where the installation jig includes an elongated body defining a longitudinal axis therethrough, and where the elongated body defines a plurality of discrete apertures positioned axially along the body, and a carrier plate. The carrier plate including a face plate defining a channel therethrough that is configured to receive a fluid coupling member therein, one or more feet extending from the face plate, and a mounting point configured to provide a location to which the installation jig may be connected to the carrier plate, and where the mounting point is configured to allow the carrier plate to be infinitely adjustable relative to the installation jig along the jig axis.

Alternatively or additionally, in any combination, where each aperture of the plurality of discrete apertures has the same size and shape.

Alternatively or additionally, in any combination, where each aperture of the plurality of discrete apertures is positioned equally along the axial length of the jig.

Alternatively or additionally, in any combination, where the mounting point includes a plurality of equally spaced apertures defined by the carrier plate.

Alternatively or additionally, in any combination, where the plurality of equally spaced apertures are positioned such that at least one aperture of the plurality of equally spaced apertures overlaps with at least one aperture of the plurality of discrete apertures of the installation jig regardless of the relative position of the carrier plate along the axial length of the installation jig.

Alternatively or additionally, in any combination, where the face plate includes a top end and a bottom end opposite the top end, where the one or more feet extend from the face plate proximate the bottom end, and where the face late further includes a bracket extending from the face plate proximate the top end.

Alternatively or additionally, in any combination, where the mounting point is located on the bracket.

Alternatively or additionally, in any combination, further comprising a second mounting point located on the face plate.

Alternatively or additionally, in any combination, where the carrier plate is a first carrier plate, the carrier assembly further comprising a second carrier plate couplable to the installation jig, and where the location of the second carrier plate along the axial length of the installation jig is infinitely adjustable relative to the location of the first carrier plate along the axial length of the installation jig.

Figure 1:
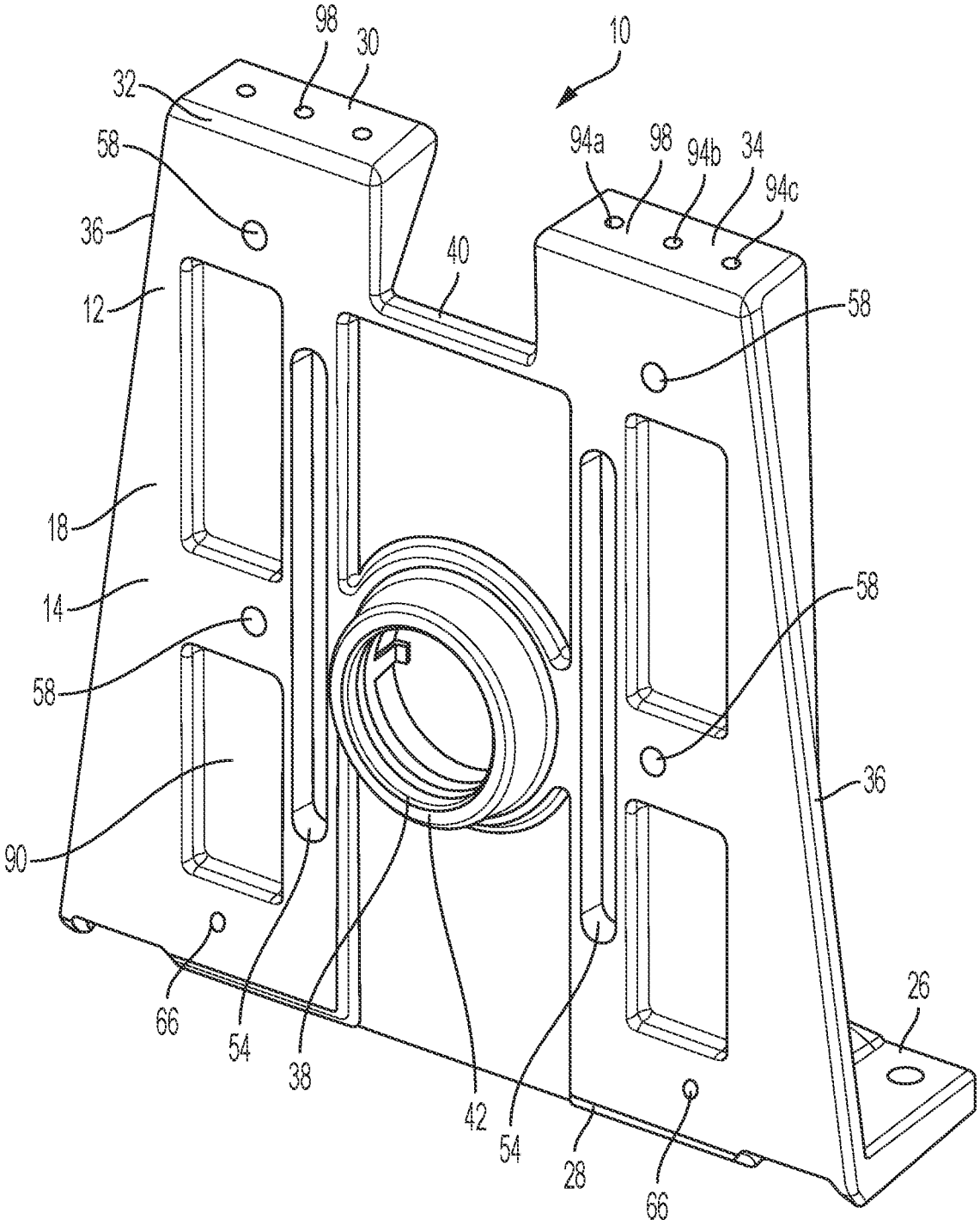
FIG. 1 is a front-perspective view of a carrier plate.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

FIGS. 1-4 illustrates a one-piece, unitary carrier plate 10 for supporting a wall-mounted water closet (e.g., a toilet, latrine, lavatory, and the like) in an elevated cantilevered position. More specifically, the carrier plate 10 is configured to be disposed within and mounted to a wall assembly (not shown), in which the carrier plate 10 provides a mounting location for the water closet. Once the water closet is installed on the carrier plate 10, the carrier plate 10 is operable to transmit any loads applied to the water closet into the wall assembly for support. In addition, the carrier plate 10 is operable to establish a fluid connection between the water closet and the plumping fixtures of the corresponding building. While the illustrated carrier plate 10 is configured for use with a modular or pre-built wall, it is understood that the carrier plate 10 may also be used together with a wall or structure built using standard construction techniques.

With continued reference to FIGS. 1-4, the carrier plate 10 includes a monolithic body 12 including a central portion or face plate 14 having a front face 18 and a rear face 22 opposite the front face 18, a pair of feet 26 extending from the rear face 22 of the face plate 14 proximate a bottom edge 28 of the face plate 14, and a pair of brackets 30, 34 extending from the rear face 22 of the face plate 14 proximate a top edge 32 thereof. In the illustrated embodiment, the monolithic body 12 includes a single casting formed from a single pour. However, in other embodiments the monolithic body 12 may be machined from a single piece of stock material, forged from a single piece of stock material, pressed or formed from a single piece of stock material, formed from some combination of the above, and the like.

As shown in FIG. 1, the face plate 14 of the carrier plate 10 includes a bottom edge 28, a top edge 32 opposite the bottom edge 28, and a pair of side edges 36 extending between the top edge 32 and the bottom edge 28. In the illustrated embodiment, the side edges 36 of the face plate 14 are angled toward one each other such that the distance or width of the face plate 14 narrows as it extends from the bottom edge 28 toward the top edge 32 to form an overall trapezoidal shape. The face plate 14 also includes a recess 40 formed into the top edge 32 thereof. Still further, the face plate 14 also defines a front plane 20 generally oriented co-planar with the front face 18 (see FIG. 4). In other embodiments different sizes and shapes of face plate 14 may be used such as rectangular, and the like.

The face plate 14 also includes an opening or channel 38 extending between the front face 18 and the rear face 22 that is configured to receive a fluid coupling member 44 therein. More specifically, the opening 38 includes a cylindrical boss or protrusion 42 extending outward from the front face 18 and formed integrally with the face plate 14. During use, the coupling member 44 is positioned within the opening 38 and configured to move axially with respect thereto to engage with and form a water-tight seal with an outlet of the water closet (not shown).

Figure 5:
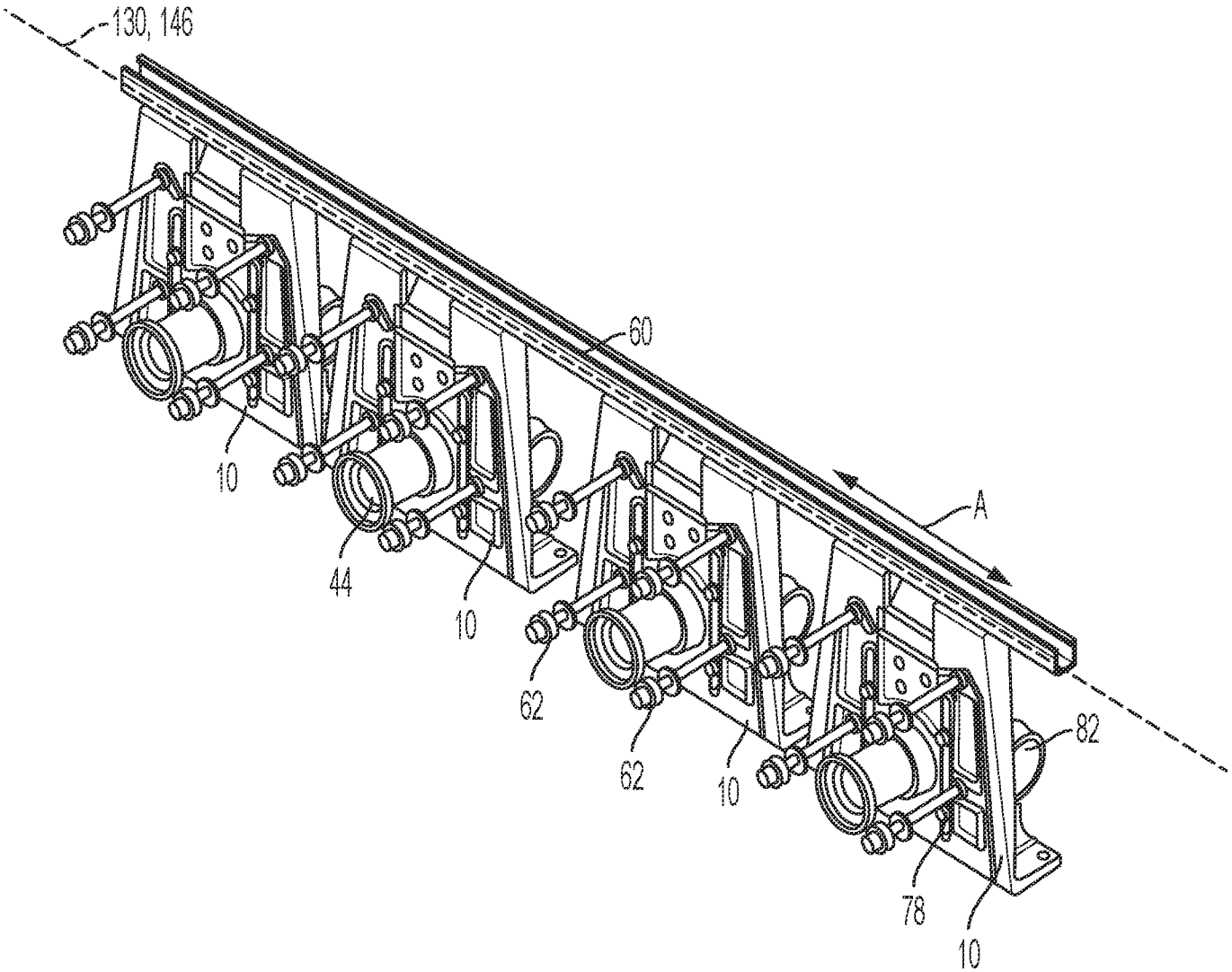
FIG. 5 is a perspective view of a group of carrier plates interconnected using a installation jig.

The face plate 14 of the carrier plate 10 also defines two elongated slots 54, each extending between the front face 18 and the rear face 22 and oriented vertically along the height of the carrier plate 10. Each slot 54 has an obround shape and is configured to receive a corresponding fastener 78 therein. The fasteners 78 are configured to mount a pipe fitting member 82 (FIG. 5) against the rear face 22 of the carrier plate 10. The pipe fitting member 82, in turn, is configured to establish fluid communication between the opening 38 of the carrier plate 10 (e.g., the fluid coupling member 44) and the plumbing fixtures of the corresponding building.

As the pipe fitting member 82 is mounted to the carrier plate 10, a water-tight seal is formed between the rear face 22 of the face plate 14 and the pipe fitting member 82. Due to the vertical orientation of the slots 54, the pipe fitting member 82 may be vertically adjusted along the rear face 22 of the face plate 14. In other constructions of the carrier plate 10, the elongated slots 54 can be replaced with circular openings at different locations to create various mounting locations for the pipe fitting member 82. The elongated slots 54 can also be oriented horizontally to allow for horizontal adjustability between the pipe fitting member 82 and the plate 10.

The face plate 14 also includes a first plurality of water closet mounting points 58 for mounting the water closet to the plate 10. As shown in FIG. 1, the first plurality of water closet mounting points 58 includes four threaded openings, each formed into the face plate 14 and spaced such that a rectangular pattern is defined. Specifically, the first plurality of water closet mounting points 58 are utilized for mounting the water closet to the carrier plate 10 via a plurality of support rods 62. When assembled, support rods 62 (FIG. 5) extend through the water closet and into the first plurality of mounting points 58 so that the water closet is securely coupled to carrier plate 10 for support. Once mounted together, loads that are applied to the water closet are ultimately transmitted into the carrier plate 10.

The face plate 14 also includes a pair of lower mounting points 66 positioned proximate the bottom edge 28 thereof and configured to provide a location to which an installation jig 60 may be connected to the plate 10 (described below). In the illustrated embodiment, each mounting point 66 includes a single aperture formed into the face plate 14 and configured to receive a fastener therein. However, in other embodiments different types of mounting points may be used such as, but not limited to, protrusions, locking pins, quick releases, and the like.

In still other embodiments, each lower mounting point 66 may include a plurality of apertures having a similar size and layout as the apertures 94 of the top mounting points 98 (described below). In such embodiments, the lower mounting points 66 would operate similar to the top mounting points 98 allowing infinite axial adjustment of the jig 60 with respect thereto.

Figure 2:
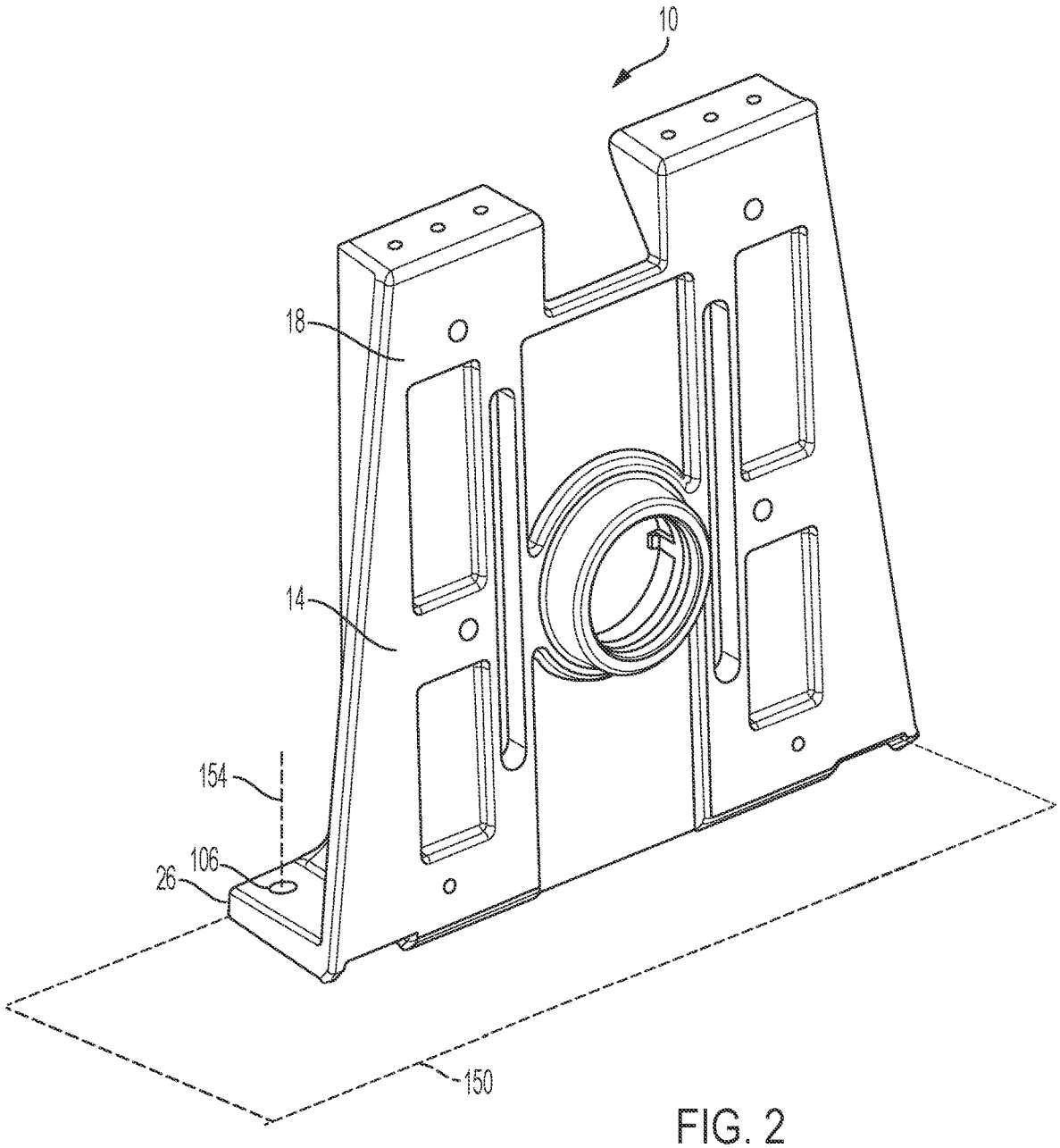
FIG. 2 is a front-perspective view of the carrier plate of FIG. 1
Figure 3:
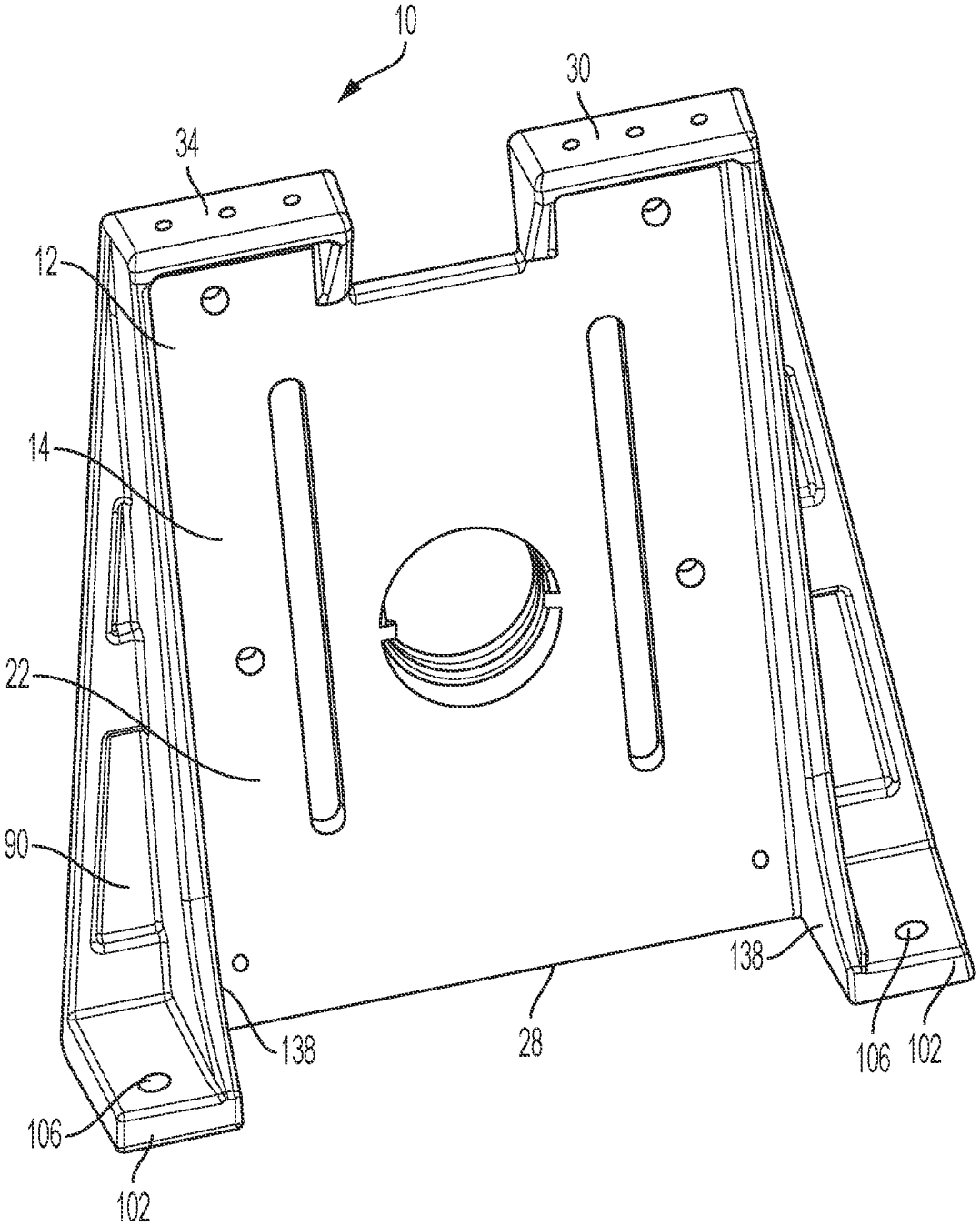
FIG. 3 is a rear-perspective view of the carrier plate of FIG. 1.

With reference to FIGS. 1-3, the face plate 14 also includes a plurality of pockets 90 formed into the front face 18 and the rear face 22 thereof. More specifically, each pocket 90 extends into the corresponding face 18, 22 to reduce the overall thickness of the plate 14 at that particular location. In the illustrated embodiment, the face plate 14 includes ten pockets 90 of varying sizes and shapes, however, in other embodiments, the face plate 14 can include more or fewer pockets 90 as required to maximize the strength of the overall face plate 14 while minimizing the overall mass of the plate 14.

Figure 4:
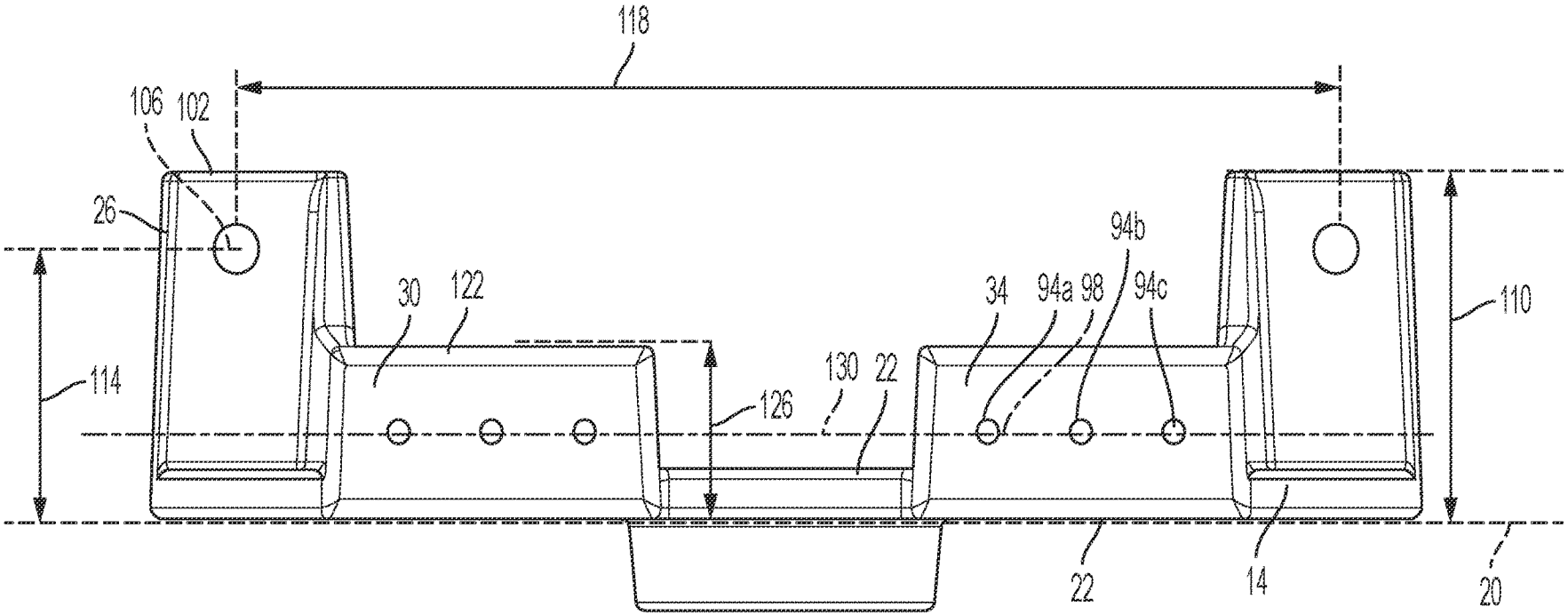
FIG. 4 is a top view of the carrier plate of FIG. 1.

As shown in FIGS. 2 and 4, the carrier plate 10 includes a pair of feet 26, each integrally formed with the body 12 and extending from the rear face 22 of the face plate 14 proximate the bottom edge 28 thereof. More specifically, each foot 26 extends generally normal to the rear face 22 of the face plate 14 to produce a distal end 102 and define an anchor aperture 106 sized to receive an anchor bolt (not shown) therein. Each foot 26 also defines a foot length 110, generally defined as the distance between the front plane 20 and the distal end 102, and an anchor length 114, generally defined as the distance between the front plane 20 and the anchor aperture 106. The carrier plate 10 also defines an anchor width 118 measured as the distance between the two anchor apertures 106.

The feet 26 also define a base plane 150 that, when the carrier plate 10 is installed on a support surface, is coincident with the support surface. In the illustrated embodiment, each foot 26 includes a plurality of ridges and protrusions that establish the base plane 150, however, in other embodiments different geometric contours (e.g., planar, ribbed, cylindrical protrusions, spikes, and the like) may be present. Furthermore, in the illustrated embodiment the base plane 150 is perpendicular to the front plane 20, however in other embodiments different relative angles may be present. Still further, in the illustrated embodiment the hole axis 154 of each anchor aperture 106 is oriented normal to the base plane 150.

In the illustrated embodiment, the anchor length 114 is between 75-100 mm. However, in other embodiments, the anchor length 114 may be between 80-90 mm. In still other embodiments, the anchor length 114 may be approximately 89 mm±0.5 mm. In still other embodiments, the anchor length 114 is between 20 and 30% of the anchor width 118.

As shown in FIGS. 1-4, the carrier plate 10 also includes a pair of brackets 30, 34, each integrally formed with the body 12 and extending from the rear face 22 of the face plate 14 proximate the top edge 32 thereof. More specifically, each bracket 30, 34 extends generally normal to the rear face 22 of the face plate 14 to define a distal end 122. Each bracket 30, 34 also defines a bracket length 126 generally defined as the distance between the front plane 20 and the distal end 122 of the corresponding bracket 30, 34.

In the illustrated embodiment, the bracket length 126 is less than the anchor length 114 and the foot length 110. More specifically, the brackets 30, 34 are positioned and sized so that neither bracket 30, 34 vertically overlaps either of the anchor apertures 106 (e.g., the area vertically above each anchor aperture 106 is uncovered). As shown in FIG. 4, the brackets 30, 34 are also positioned so that the brackets 30, 34 are offset laterally (e.g., from side to side) from the feet 26 so that no part of the bracket 30, 34 laterally overlaps the feet 26. In other embodiments, the brackets 30, 34 are positioned so that the brackets 30, 34 are offset laterally from the anchor apertures 106 so that no part of the brackets 30, 34 laterally overlap with the anchor apertures 106. In still other embodiments, each bracket 30, 34 is sized and shaped so that each bracket 30, 34 is offset laterally and longitudinally (e.g., front to back) from the anchor apertures 106 so that no part of the brackets 30, 34 laterally or longitudinally overlap with the anchor apertures 106. In the illustrated embodiment, both brackets 30, 34 define a bracket length 126 between 50 and 60 mm.

In still other embodiments, each anchor aperture 1306 defines a corresponding anchor zone. The anchor zone, in turn, includes the volume delineated by the cross-sectional shape of the anchor aperture 106 extended normal to the base plane in both directions therefrom. In other embodiments, the anchor zone may include the volume delineated by the cross-sectional shape of the anchor aperture 106 extended along the anchor axis 154. As shown in FIG. 4, the brackets 30, 34 are sized, shaped, and positioned such that no part of the brackets 30, 34 are positioned within any anchor zone.

Figure 6:
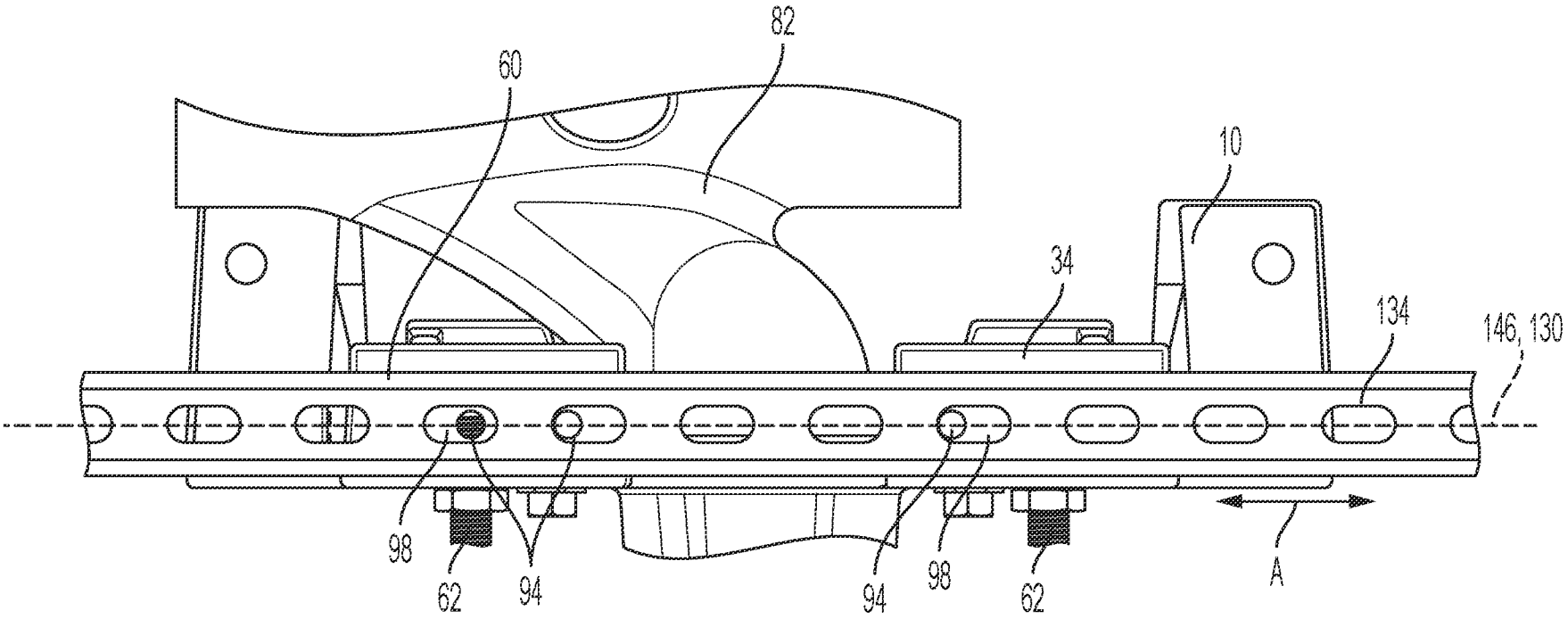
FIG. 6 is a detailed top view of the installation jig of FIG. 5 attached to a corresponding carrier plate.
Figure 7B:
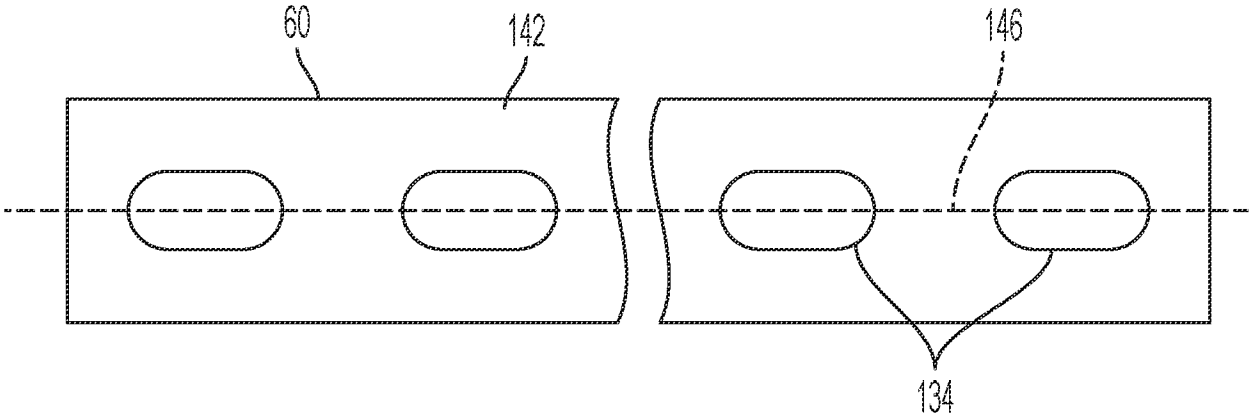
FIG. 7B is a top view of the installation jig of FIG. 5.
Figure 7A:
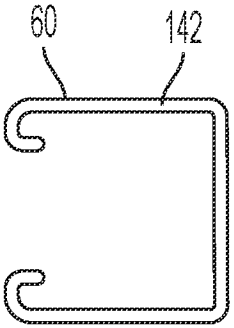
FIG. 7A is an end view of the installation jig of FIG. 5.

Each bracket 30, 34 also includes a corresponding top mounting point 98 configured to provide a location to which an installation jig 60 may be connected to the plate 10 (described below). Each top mounting point 98 includes a plurality of equally spaced apertures 94*a*, 94*b*, 94*c* and defines a mounting axis 130 passing through the centers of each of the apertures 94*a*, 94*b*, 94*c*. More specifically, the apertures 94*a*, 94*b*, 94*c*, are sized and spaced relative to one another so that the installation jig 60 may be infinitely adjustable along the mounting axis 130 (e.g., in direction A, see FIGS. 5 and 6). Stated differently, the top mounting point 98 includes a sufficient number of apertures 94 positioned in a pattern along the axis 130 such that at least one aperture 94 is always accessible through the apertures 134 of the installation jig 60 regardless of the position of the installation jig 60 along the axis 130 and in direction A. In the illustrated embodiment, the top mounting point 98 includes three apertures 94*a*, 94*b*, 94*c* each threaded with ⅜-16 UNC threads and spaced between 32.9-33.7 mm apart center to center. However, in other embodiments, the apertures 94*a*, 94*b*, 94*c* may include any threaded size 9⁄16" and below. In still other embodiments, the apertures 94*a*, 94*b*, 94*c* may not be threaded. In such embodiments, the apertures 94*a*, 94*b*, 94*c* may have a diameter that is no greater than 9⁄16".

As shown in FIG. 3, the body 12 also includes a pair of ribs 138, each integrally formed with the body 12 and extending between the rear face 22 of the face plate 14, a corresponding bracket 30, 34, and a corresponding foot 26 to provide additional strength and support for the entire structure. In the illustrated embodiment, both ribs 138 extend along the entire vertical height of the face plate 14 (e.g., from the foot 26 to the bracket 30, 34).

With reference to FIGS. 5-7B, the installation jig 60 is an elongated member configured to be attached to two or more carrier plates 10 to maintain the relative spacing therebetween during the installation process. More specifically, the installation jig 60 has an elongated body 142 defining a longitudinal axis 146 therethrough. The body 142, in turn, defines a plurality of discrete apertures 134 spaced axially along the length of the body 142. In the illustrated embodiment, the apertures 134 are positioned equally along the entire axial length of the body 142, however in alternative embodiments, different layouts and patterns of apertures 134 may be used. As stated above, the apertures 134 of the installation jib 60 are sized and positioned along the axial length of the body 142 in a pattern such that when used in combination with the size and position of the apertures 94*a*, 94*b*, 94*c* of a particular top mounting point 98 at least one fastener can pass through an aperture 134*c* of the installation jig 60 and into an aperture 94 of the corresponding top mounting point 98 regardless of the relative position of the installation jig 60 and the plate 10 along the mounting axis 130. Stated differently, at least one aperture 134 of the installation jig 60 overlaps at least one aperture 98 of a corresponding top mounting point 98 regardless of the relative position of the installation jig 60 and the plate 10 along the mounting axis 130. In the illustrated embodiment, the apertures 134 of the installation jig 60 are obround in shape being approximately 1.125" long in the axial direction and 0.5625" wide perpendicular to the axis 146. The illustrated apertures 134 are also equally spaced along the entire axial length of the body 142 being spaced 2" apart center to center.

To install a plurality of carrier plates 10, the user first positions each of the carrier plates 10 at the approximate distance from each other desired for the final installation and generally aligned with each other. The user then places an installation jig 60 along the tops of each carrier plate 10 so that the installation jig 60 generally lies on the brackets 30, 34 of each plate 10.

With the jig 60 and carrier plates 10 in position, the user can the secure the installation jig 60 to a first carrier plate 10, passing a fastener through a respective aperture 134 of the jig 60 and into and threaded with an uncovered aperture 94 one of the two top mounting points 98. The same is then done for the second upper mounting point 98.

With the first plate 10 secured, the user can then precisely align the second carrier plate 10 with respect thereto. To do so, the user adjusts the position of the second plate 10 so that axis 146 of the jig 60 rests along and is co-axial with the mounting axis 130. Using a tape measure or other device, the user can then axially slide the second carrier plate 10 along the axial length of the jig 60 until the desired distance between the first plate 10 and the second plate 10 is achieved. As described above, the apertures 134 of the jig 60 and the apertures 94 of the two top mounting points 98 of the second plate 10 allow for infinite adjustment along direction A therebetween whereby at least one pair of apertures 94, 134 between the jig 60 and each of the two top mounting points 98 will overlap at every axial position therebetween.

Once the second carrier 10 is positioned relative to the first carrier 10, the user may then secure the jig 60 to the second carrier 10 using at least one fastener for each top mounting point 98. The user may then repeat this step for however many carriers 10 are present in the installation.

With all of the carriers 10 in place, the user may then lift up the resulting assembly (e.g., using a fork lift and the like) and place the assembly in the desired location—whereby the installation jig 60 maintains the relative positioning between each of the carriers 10 while being moved.

Once in place, all of the carriers 10 may be secured in place by passing an anchor bolt through each of the anchor apertures 106 of each of the carriers 10.

Although the invention has been described in detail with reference to certain preferred embodiments, variations and modifications exist within the scope and spirit of one or more independent aspects of the invention as described.

The invention claimed is:

1. A carrier plate for supporting a wall-mounted water closet, the carrier plate comprising:

a face plate having a top end, a bottom end opposite the top end, a front face, and a rear face opposite the front face, wherein the face plate defines a channel extending between the front face and the rear face configured to receive a fluid coupling member therein;

a bracket extending from the rear face of the face plate proximate the top end to define a bracket length; and one or more feet extending from the rear face of the face plate proximate the bottom end to define a foot length and a base plane, wherein the foot defines an anchor aperture therethrough, and wherein the anchor aperture defines an anchor zone including a volume delineated by the cross-section of the anchor aperture extended normal to the base plane in both directions therefrom, and wherein the bracket is not positioned within the anchor zone.

2. The carrier plate of claim 1, wherein the front face of the face plate defines a front plane, and wherein the front plane is perpendicular to the base plane.

3. The carrier plate of claim 2, wherein the bracket is positioned so that it does not overlap the anchor aperture in a direction taken along the front plane and normal to the front plane.

4. The carrier plate of claim 1, wherein the face plate includes a plurality of feet extending from the rear face of the face plate proximate the bottom end, wherein each foot of the plurality of feet define an anchor aperture, wherein each anchor aperture defines a corresponding anchor zone, and wherein the bracket is not positioned within any anchor zone.

5. The carrier plate of claim 1, wherein the face plate, bracket, and one or more feet are all formed from a single piece of stock material.

6. The carrier plate of claim 1, wherein the face plate defines a channel extending between the front face and the rear face and that is configured to receive a fluid coupling member therein.

7. The carrier plate of claim 1, further comprising a second bracket extending from the rear face of the face plate proximate the top end, and wherein the second bracket is not positioned within the anchor zone.

8. The carrier plate of claim 1, further comprising a mounting point configured to provide a location to which an installation jig may be connected to the carrier plate.

9. The carrier plate of claim 8, wherein the mounting point includes a plurality of equally spaced apertures formed into the bracket.

10. The carrier plate of claim 8, wherein the mounting point includes an aperture formed into the face plate.

11. The carrier plate of claim 1, wherein the one or more feet include a pair of feet defining an anchor width therebetween, and wherein the anchor length is between 20% to 30% of the anchor width.

12. A carrier assembly for supporting a wall-mounted water closet, the carrier assembly comprising:

an installation jig, wherein the installation jig includes an elongated body defining a longitudinal axis therethrough, and wherein the elongated body defines a plurality of discrete apertures positioned axially along the body; and a carrier plate including:

a face plate defining a channel therethrough that is configured to receive a fluid coupling member therein, one or more feet extending from the face plate, and a mounting point configured to provide a location to which the installation jig may be connected to the carrier plate, wherein the mounting point is configured to allow the carrier plate to be infinitely adjustable relative to the installation jig along the jig axis.

13. The carrier assembly of claim 12, wherein each aperture of the plurality of discrete apertures has the same size and shape.

14. The carrier assembly of claim 12, wherein each aperture of the plurality of discrete apertures is positioned equally along the axial length of the jig.

15. The carrier assembly of claim 12, wherein the mounting point includes a plurality of equally spaced apertures defined by the carrier plate.

16. The carrier assembly of claim 15, wherein the plurality of equally spaced apertures are positioned such that at least one aperture of the plurality of equally spaced apertures overlaps with at least one aperture of the plurality of discrete apertures of the installation jig regardless of the relative position of the carrier plate along the axial length of the installation jig.

17. The carrier assembly of claim 12, wherein the face plate includes a top end and a bottom end opposite the top end, wherein the one or more feet extend from the face plate proximate the bottom end, and wherein the face late further includes a bracket extending from the face plate proximate the top end.

18. The carrier assembly of claim 17, where the mounting point is located on the bracket.

19. The carrier assembly of claim 18, further comprising a second mounting point located on the face plate.

20. The carrier assembly of claim 12, wherein the carrier plate is a first carrier plate, the carrier assembly further comprising a second carrier plate couplable to the installation jig, and wherein the location of the second carrier plate along the axial length of the installation jig is infinitely adjustable relative to the location of the first carrier plate along the axial length of the installation jig.

* * * * *